US008003966B2

(12) United States Patent
Temus et al.

(10) Patent No.: US 8,003,966 B2
(45) Date of Patent: Aug. 23, 2011

(54) TRANSPORTATION CONTAINER AND ASSEMBLY

(75) Inventors: Charles Joseph Temus, Puyallup, WA (US); Bryan Flanagan, Richland, WA (US)

(73) Assignee: AREVA Federal Services LLC, Federal Way, WA (US)

( * ) Notice: Subject to any disclaimer, the term of this patent is extended or adjusted under 35 U.S.C. 154(b) by 86 days.

(21) Appl. No.: 11/844,968

(22) Filed: Aug. 24, 2007

(65) Prior Publication Data

US 2008/0073601 A1 Mar. 27, 2008

Related U.S. Application Data

(60) Provisional application No. 60/840,135, filed on Aug. 24, 2006.

(51) Int. Cl.
*G21F 5/00* (2006.01)

(52) U.S. Cl. ..... 250/506.1; 250/507.1

(58) Field of Classification Search ..... 250/506.1, 250/507.1; 220/4.05, 4.07, 4.21, 4.24, 62.19
See application file for complete search history.

(56) References Cited

U.S. PATENT DOCUMENTS

| | | | | | |
|---|---|---|---|---|---|
| 3,754,140 | A | * | 8/1973 | Beierle | 250/507.1 |
| 4,377,509 | A | * | 3/1983 | Haynes et al. | 588/16 |
| 4,381,844 | A | | 5/1983 | Bondy | |
| 4,509,506 | A | * | 4/1985 | Windorski et al. | 600/8 |
| 4,623,510 | A | * | 11/1986 | Troy | 376/272 |
| 4,896,046 | A | * | 1/1990 | Efferding | 250/507.1 |
| 4,920,270 | A | * | 4/1990 | Grodzins | 250/364 |
| 4,997,618 | A | * | 3/1991 | Efferding | 376/272 |
| 5,063,299 | A | * | 11/1991 | Efferding | 250/507.1 |
| 5,337,917 | A | | 8/1994 | Pierce | |
| 5,397,902 | A | * | 3/1995 | Castner et al. | 250/432 PD |
| 5,752,603 | A | * | 5/1998 | Faber | 206/530 |
| 5,834,788 | A | * | 11/1998 | Fu et al. | 250/506.1 |
| 6,299,950 | B1 | * | 10/2001 | Byington et al. | 428/34.5 |
| 6,372,157 | B1 | * | 4/2002 | Krill et al. | 252/478 |
| 6,495,846 | B1 | * | 12/2002 | Vaughan | 250/506.1 |
| 6,692,426 | B1 | * | 2/2004 | Faulkner et al. | 600/8 |
| 6,802,828 | B2 | * | 10/2004 | Reynolds | 604/199 |
| 6,805,253 | B1 | * | 10/2004 | Nicholson et al. | 220/4.05 |
| 6,960,311 | B1 | * | 11/2005 | Mirsky et al. | 252/478 |
| 6,989,543 | B2 | * | 1/2006 | Drobnik et al. | 250/455.11 |
| 2002/0178566 | A1 | * | 12/2002 | Reich | 29/426.5 |
| 2004/0016098 | A1 | * | 1/2004 | Reich | 29/428 |
| 2005/0269331 | A1 | | 12/2005 | Blanton | |

FOREIGN PATENT DOCUMENTS

DE 2311162 A1 9/1974

OTHER PUBLICATIONS

NuPac Model No. N-55 Packaging Safety Analysis Report (NuPac N-55 SAR), Nuclear Packaging, Inc., Revision 2, Sep. 1987, pp. 1-1-1-4.

(Continued)

*Primary Examiner* — Robert Kim
*Assistant Examiner* — Johnnie L Smith
(74) *Attorney, Agent, or Firm* — Christensen O'Connor Johnson Kindness PLLC

(57) ABSTRACT

Embodiments of the present disclosure relate generally to transportation containers and assemblies, such as transportation containers and assemblies for containing and transporting radioactive material. A transportation assembly for transporting radioactive material generally includes an outer container defining an inner cavity, the outer container having an inner shell, wherein at least a portion of the inner shell includes a plurality of layers including at least one layer of chopped fiberglass mat and at least one layer of aramid fabric. The transportation assembly may further include an inner container disposed within the inner cavity of the outer container.

23 Claims, 8 Drawing Sheets

OTHER PUBLICATIONS

PCT International Search Report dated Jul. 8, 2008, issued in corresponding Application No. PCT/US2007/076796, filed Aug. 24, 2007.

International Preliminary Report on Patentability dated Feb. 24, 2009, issued in corresponding International Application No. PCT/US07/76796, filed Aug. 24, 2007.

Office Action dated Jun. 10, 2010, issued in corresponding Canadian Application No. 2,653,943, filed Aug. 24, 2007.

Office Action dated Dec. 20, 2010, issued in corresponding European Application No. 07872274.1 filed Aug. 24, 2007.

* cited by examiner

TRANSPORTATION CONTAINER AND ASSEMBLY

CROSS-REFERENCE TO RELATED APPLICATION

This application claims the benefit of U.S. Provisional Patent Application No. 60/840,135, filed Aug. 24, 2006, the disclosure of which is hereby expressly incorporated by reference.

TECHNICAL FIELD

Embodiments of the present disclosure relate generally to transportation containers and assemblies and, more specifically, to transportation containers and assemblies for containing and transporting radioactive material.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with embodiments of the present disclosure, a transportation assembly for transporting radioactive material is provided. The transportation assembly generally includes an outer container defining an inner cavity, the outer container having an inner shell, wherein at least a portion of the inner shell includes a plurality of layers including at least one layer of chopped fiberglass mat and at least one layer of aramid fabric. The transportation assembly further includes an inner container disposed within the inner cavity of the outer container.

In accordance with other embodiments of the present disclosure, an outer container to provide protection for an inner container for transporting radioactive material is provided. The outer container generally includes first and second portions defining an inner cavity, the first and second portions both having an inner shell, wherein at least a portion of the inner shell includes a plurality of layers including at least one layer of chopped fiberglass mat and at least one layer of aramid fabric.

In accordance with other embodiments of the present disclosure, an outer container to provide protection for an inner container for transporting radioactive material is provided. The outer container generally includes first and second portions coupled to one another at an interface, wherein the first and second portions define an inner cavity. The outer container further includes a closure system for securing the first and second portions to one another, wherein the closure system includes a plurality of latches and a plurality of fasteners.

In accordance with other embodiments of the present disclosure, a method of transporting radioactive material is provided. The method generally includes placing an inner container into an outer container, wherein the inner container contains radioactive material. The outer container includes first and second portions defining an inner cavity, the first and second portions both having an inner shell, wherein at least a portion of the inner shell includes a plurality of layers including at least one layer of chopped fiberglass mat and at least one layer of aramid fabric. The method further includes securing the first and second portions of the outer container using a closure system, wherein the closure system includes a plurality of latches and a plurality of fasteners.

DESCRIPTION OF THE DRAWINGS

The foregoing aspects and many of the attendant advantages of this disclosure will become better understood by reference to the following detailed description, when taken in conjunction with the accompanying drawings, wherein.

DETAILED DESCRIPTION

Figure 1:
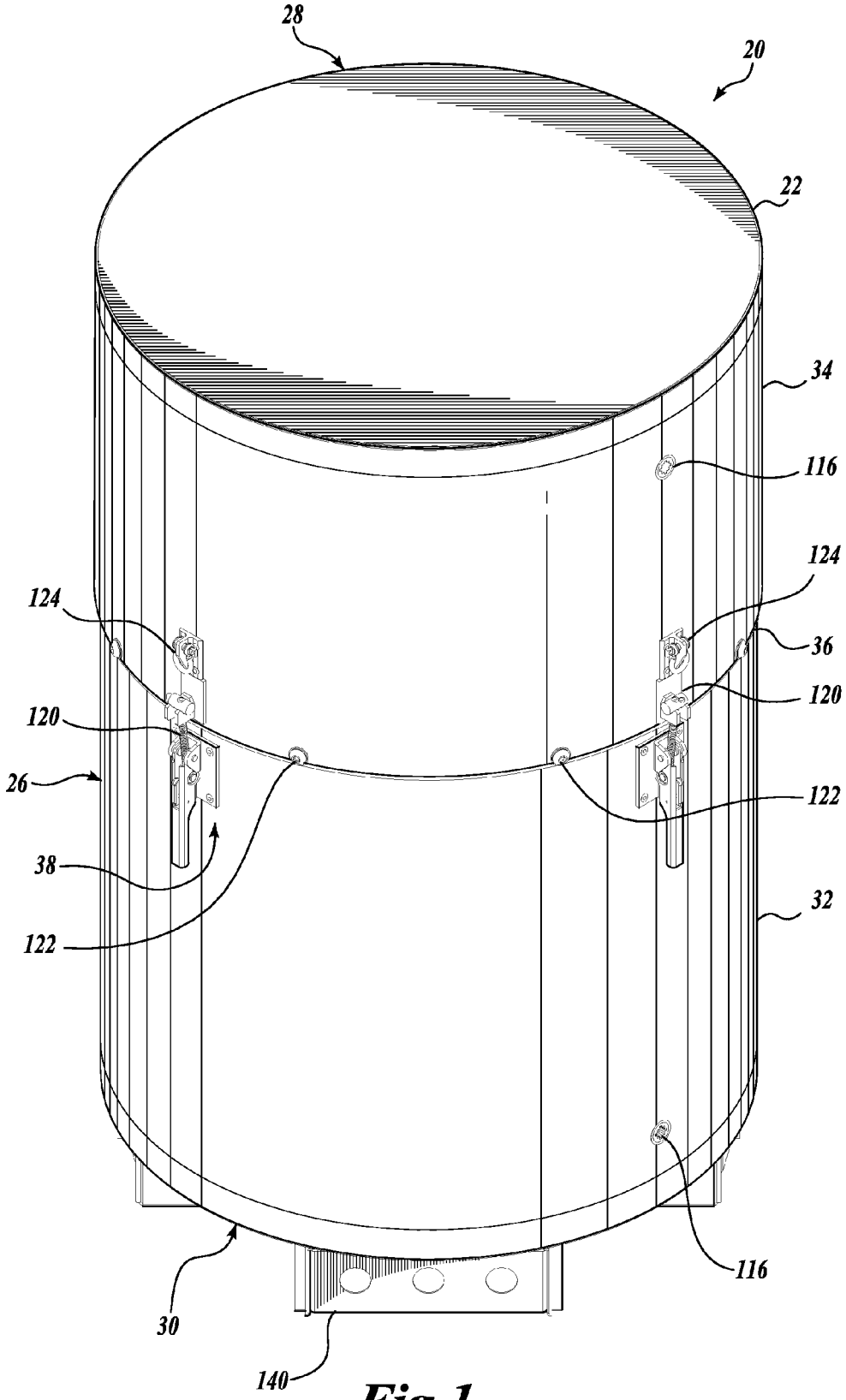
FIG. 1 is a perspective front view of a transportation assembly in accordance with one embodiment of the present disclosure.
Figure 2:
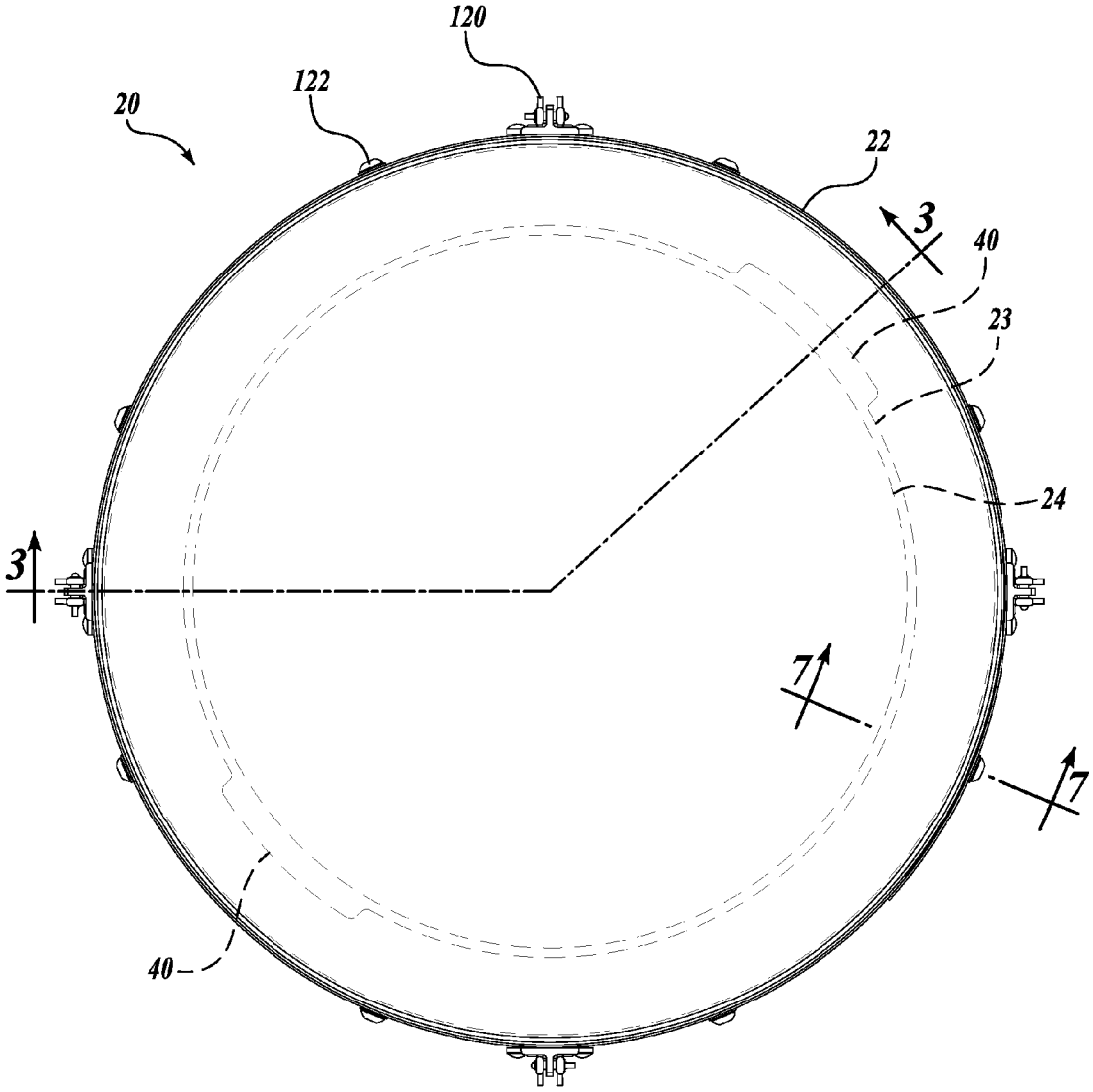
FIG. 2 is a top view of the transportation assembly of FIG. 1.
Figure 3:
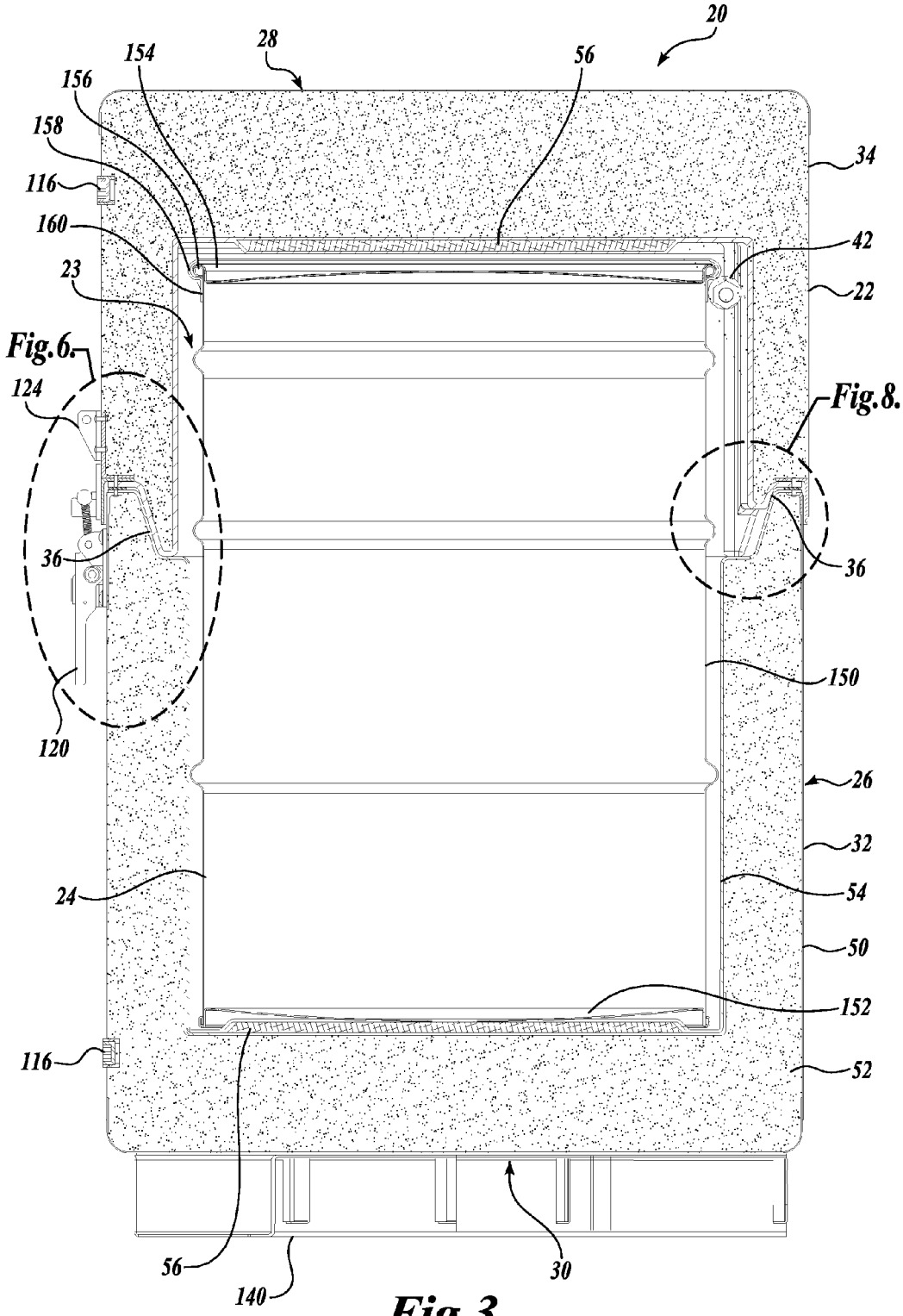
FIG. 3 is a cross-sectional view of the transportation assembly of FIG. 1 taken through plane 3-3 shown in FIG. 2.

Embodiments of the present disclosure are generally directed to transportation containers and assemblies for radioactive material. Referring to FIGS. 1-3, there is shown a transportation assembly, generally indicated 20, constructed in accordance with the one embodiment of the present disclosure. The assembly 20 generally includes an outer container 22 defining an inner cavity 23, and an inner container 24 disposed within the inner cavity 23 of the outer container 22 (see FIGS. 2 and 3). As will be described in detail below, the outer container 22 and the inner container 24 are cooperatively configured and arranged such that the outer container 22 provides insulation and protection to the inner container 24 during the normal conditions of transport, as well as in hypothetical accident conditions.

Embodiments of the assembly 20 described herein are designed and configured for the transportation of radioactive material including fissile material in the form of dry solids, such as enriched uranium oxide. As a non-limiting example, the enriched uranium oxide may be a powder enriched to a maximum of 1.2%. In that regard, embodiments of the assembly 20 are minimally designed to protect the transport staff, other people, and the environment from the potentially hazardous material as a result of fire, submersion, impact, or damage to the assembly 20. However, it should be appreciated that embodiments of the assembly 20 described herein can also be used to transport other radioactive or nonradioactive material.

Embodiments of the assembly 20 are generally designed to contain the radioactive material without release to the environment when subjected to standard crush, drop, puncture, hypothetical fire, and water immersion tests required for their certification. Further, embodiments of the assembly 20 of the present disclosure are generally sized and configured to be transportable, for example, to be carried by a suitable transportation means, such as truck or rail. However, it should be appreciated that non-portable or stationary assemblies are also within the scope of the present disclosure.

While embodiments of the transportation assembly 20 described herein generally include an outer container 22 having an inner container 24 disposed within the inner cavity 23 of the outer container 22, it should be appreciated that embodiments of the present disclosure are also directed to a discrete outer container 22, i.e., without an inner container.

Referring to FIG. 3, the outer container 22 will now be described in greater detail. The outer container 22 is not designed as the containment boundary for the radioactive material. Rather, it is an "overpack" device designed to protect the inner container 24 (which is designed to contain radioactive material) and reduce the severity in a hypothetical accident condition by preventing any loss of contents from the inner container 24. In the illustrated embodiment, as best seen in FIG. 3, the outer container 22 is a substantially cylindrical container having an outer wall 26 and first and second ends 28 and 30, shown as top and bottom ends 28 and 30 in FIG. 3. While the illustrated embodiment is shown as a cylindrical container, it should be appreciated that other shapes are also within the scope of the present disclosure.

The outer container 22 includes two couplable portions, a first portion 32 and a second portion 34. The first portion 32 is substantially a lower portion when the outer container 22 is oriented in its upright position, as best seen in FIGS. 1 and 3. In that regard, the first portion 32 generally includes the bottom end 30 of the outer container 22 and a portion of the wall 26. The second portion 34 is substantially an upper portion when the outer container 22 is oriented in its upright position, generally including the top end 28 of the outer container 22 and a portion of the wall 26. As described in greater detail below, the lower and upper portions 32 and 34 are couplable to one another at a joint or interface 36 along the wall 26, and are securably attachable by a closure system 38 (for example, including latches 120 and fasteners 122 shown in FIGS. 6 and 7, respectively) located along the outer perimeter of the wall 26 at the interface 36.

The lower and upper portions 32 and 34, when coupled together, define the inner cavity 23, which is designed and configured to receive the inner container 24. In that regard, FIG. 2 is a top view of the outer container 22, showing the inner container 24 and inner cavity 23 in phantom lines. Referring to FIG. 2, two recesses or keyways 40 in the inner cavity 23 are shown. The recess or keyways 40 in the inner cavity 23 are designed to accommodate a closure system 42 on the inner container 24, which is described in greater detail below. As best seen in FIG. 3, when in use, the inner container 24 can be received within the inner cavity 23 of the lower portion 32 of the outer container 22. The upper portion 34 of the outer container 22 is placed on top of the lower portion 32, such that the two portions 32 and 34 are coupled and in alignment at their interface 36. As best seen in FIG. 1, the outer container 22 is then secured in the closed position by its closure system 38.

As mentioned above, the outer container 22 is designed to protect and insulate the inner container 24. In that regard, the ends 28 and 30 and walls 26 of each of the lower and upper portions 32 and 34 of the outer container 22 are made up of a plurality of materials, configured as layers in a sandwich lay-up, as best seen in FIG. 3. In the illustrated embodiment, each of the lower and upper portions 32 and 34 have three layers: an outer shell 50, an intermediate liner 52, and inner shell 54, each of which provide individual protective and insulative properties that make up the properties of the outer container 22 as a whole. It should be appreciated that the outer shell 50, the intermediate liner 52, and the inner shell 54 may be of different lay-up configurations, for example, the lower and upper portions 32 and 34 may have unique lay-up configurations. However, each layer will be described generally below for application in any of the outer container 22 portions, e.g., either of the lower and upper portions 32 and 34. Moreover, while in the illustrated embodiment, the outer container 22 is shown as generally having three layers, it should be appreciated that more than three layers are within the scope of the present disclosure.

The outer shell 50 is designed and configured to provide a rigid, protective, external surface for the outer container 22, for example, to provide durability and prevent degradation of the outer container 22 during use. In that regard, the outer shell 50 may be configured from a weldable sheet metal, so as to provide ease of manufacturing by being weldable. As a non-limiting example, the outer shell 50 is made from 18 gauge galvanized carbon steel or stainless steel sheet metal; however, it should be appreciated that other materials, whether metal or non-metal are also within the scope of the present disclosure. It should further be appreciated that the outer shell 50 may include more than one layer of material, for example, at a particular location for additional strength or reinforcement purposes. In the illustrated embodiment, the outer shell 50 has continuous welded seams on the exterior side and stitch welding on the interior side of the lap joints and for attaching structural angles 100, 104, and 108 (described in greater detail below with reference to FIGS. 6-8).

The intermediate liner 52 is designed to provide both impact and thermal protection for the material being contained within the inner container 24, and is suitably configured as a light weight material compared to the outer and inner shells 50 and 54. As such, the intermediate liner 52 may have certain density and compressive strength properties, as well as flame retardant and intumescent properties. In one embodiment, the intermediate liner 52 is formed from polyurethane foam, having a density of about 3 $lb/ft^3$+/−15%. However, it should be appreciated that other light weight, energy-absorbing, thermal-insulative materials having similar densities and compressive strength properties are also within the scope of the present disclosure.

The intermediate liner 52 may have suitable compressive strength, such that when loaded parallel-to-rise in a compression strength test, under strains of about 10%, 40%, and 70%, the intermediate liner 52 may have strain values of about +/−15% of 67, 56, and 87 psi, respectively. In addition, when loaded perpendicular-to-rise in a compression strength test, under strains of about 10%, 40%, and 70%, the intermediate liner 52 may have strain values of about +/−15% of 41, 41, and 75 psi, respectively. In one embodiment, a foam intermediate liner 52 is preferably installed such that the rise of the foam is parallel with the axial direction. In another embodiment, a liquid foam can be poured into the cavity between the inner and outer shells 54 and 50 and allowed to expand therein, completely filling the void.

Regarding the flame retardant properties, the intermediate liner may have the following flame extinguishment results when subjected to a 1500° F. flame: fire extinguishment of the sample in less than about 15 seconds; flame extinguishment of any drips from the test sample in less than about 3 seconds; and an average burn length of the sample of less than about 6 inches. In addition, the intermediate liner may have an intumescence result of greater than about zero.

As a non-limiting example, the foam thickness of the lower portion 32 of the outer container 22 may be in the range of about 3½ inches to about 2½ inches. It should be appreciated, however, that the foam thickness may be greater on the top and bottom ends 28 and 30 of the outer container 22 for greater impact and thermal insulation protection. In that regard, as a non-limiting example, the foam thickness of the top and bottom ends 28 and 30 of the outer container 22 may be in the range of about 5⅛ inches to about 6⅞ inches.

The inner shell 54 is designed and configured to provide fire resistance or retardance, resistance to corrosion, resistance to abrasion, impact resistance, toughness, and strength to the outer container 22, during both normal conditions of transport and hypothetical accident conditions. In that regard, the inner shell 54 is suitably designed to prevent any penetration into the inner cavity of the outer container 22, for example, by fire or by any materials from the outer shell 50 or intermediate liner 52 if damage occurs to the outer container 22 as a result of, for example, crushing, dropping, or puncturing the assembly 20. A suitable inner shell 54 is flame retardant such that when subjected to a 1500° F. flame for 60 seconds, the flame extinguishment time does not exceed 30 seconds and the extinguishment time of drips from the test sample do not exceed 10 seconds.

In one embodiment, the inner shell 54 includes a double bias glass fabric, for example, fabric style DBM1708, manufactured by OWENS CORNING®, which combines a glass mat and equal amounts of continuous knitted biaxial glass fiber oriented in the +45° and −45° directions into a single fabric. In another embodiment of the present disclosure, the inner shell 54 comprises a plurality of layers in a lay-up design, including at least one layer of aramid fabric, commonly known as KEVLAR® fabric, and at least one layer of chopped fiberglass. It should be appreciated that other layers may be included in the lay-up design, including, but not limited to, double bias glass fabric material, as well as multiple layers or aramid fabric, chopped fiberglass, and/or double bias glass fabric material. Aramid fabric provides strength to the inner shell 54. Double bias glass fabric provides improved tear resistance, penetration resistance, and strength to the inner shell 54. Chopped fiberglass adds spacing between the stronger double bias glass fabric and aramid layers to allow proper bonding between the layers of the lay-up and create a combination high strength, minimum weight inner shell 54. It should further be appreciated that fire retardant resins may also be added to the fabric, aramid, and fiberglass layers.

In another embodiment, the inner shell 54 comprises a plurality of layers in a lay-up design, including at least one layer of double bias glass fabric material and at least one layer of aramid fabric. In yet another embodiment, the inner shell 54 comprises a plurality of layers in a lay-up design, including at least one layer of double bias glass fabric material, at least one layer of aramid fabric, and at least one layer of chopped fiberglass. It should be appreciated that the double bias glass fabric in the inner shell 54 can be oriented such the fibers run 45° offset from an axis line running along the wall 26 from the top end 28 to the bottom end 30 of the outer container 22. In addition, it should be appreciated that the aramid fabric may be oriented such that the fibers run at a different angle than the double bias glass fabric. It should be further appreciated that the inner shell 54 may further include an optional inner gel coat on the inner surfaces of the lay-ups at the top and bottom ends 28 and 30 as well as the wall 26 of the outer container 22 for an added layer of protection to the inner surfaces of the inner shell 54.

Figure 4:
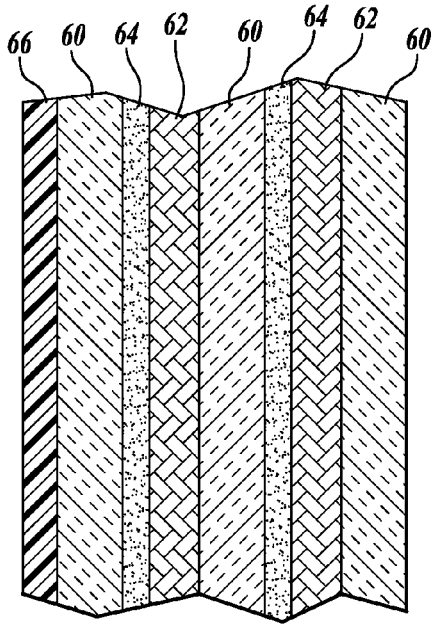
FIG. 4 is a partial, close-up, cross-sectional view of a first exemplary lay-up of a portion of a wall of an outer container of the transportation assembly of FIG. 1.
Figure 5:
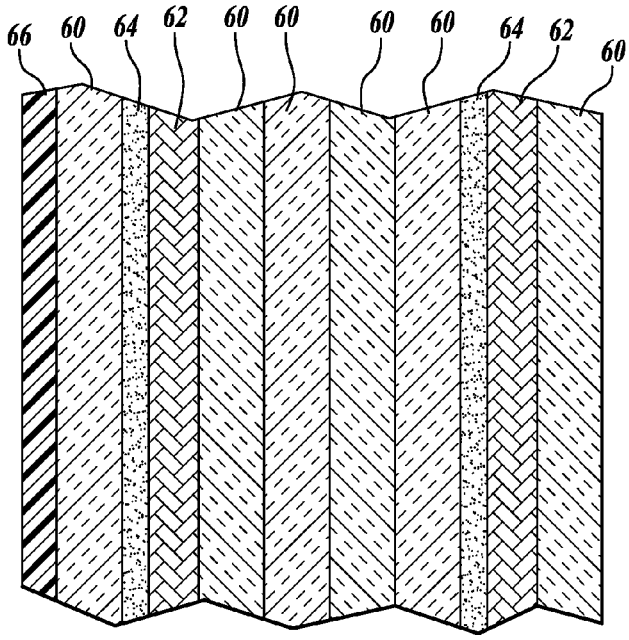
FIG. 5 is a partial, close-up, cross-sectional view of a second exemplary lay-up of a portion of a wall of the outer container of the transportation assembly of FIG. 1.

As a non-limiting example, referring to FIG. 4, the inner shell 54 may include at least seven layers in a lay-up order as follows from right to left: double bias glass fabric 60, aramid fabric 62, chopped fiberglass 64, double bias glass fabric 60, aramid fabric 62, chopped fiberglass 64, and double bias glass fabric 60. An optional gel coat 66 is the eighth layer in the illustrated embodiment of FIG. 4. Such a lay-up has a thickness of about ⅛ inch. As another non-limiting example, referring to FIG. 5, the inner shell 54 includes at least ten layers in a lay-up order as follows from right to left: double bias glass fabric 60, aramid fabric 62, chopped fiberglass 64, four layers of double bias glass fabric 60, aramid fabric 62, chopped fiberglass 64, and double bias glass fabric 60. An optional gel coat 66 is the eleventh layer in the illustrated embodiment of FIG. 5. Such a lay-up has a thickness of about ¼ inch. However, it should be appreciated that any number of lay-up layers that meet the desired strength and weight properties for the inner shell 54 are within the scope of the present disclosure. As best seen in the illustrated embodiment of FIG. 3, the inner shell 54 of the upper portion 34 of the outer container 22 is a thicker lay-up, for example, a ten layer lay-up in the exemplary lay-up order described above, and the inner shell 54 of the lower portion 32 of the outer container 22 is a thinner lay-up, for example, a seven layer lay-up in the exemplary lay-up order described above.

In addition to the layers, the inner shell 54 at that top and bottom ends 28 and 30 of the outer container 22 may include an optional stiffening member 56 (see FIG. 3) to stiffen the inner shell 54 and provide additional crush protection at the top and bottom ends 28 and 30 of the outer container 22. It should be appreciated that the stiffening member 56 may be sandwiched between lay-up layers to help the stiffening member 56 resist buckling and shattering under load or when subjected to dropping, crushing, or puncture forces. In one embodiment, the stiffening member 56 is a plywood sheet. It should be appreciated, however, that other stiffening materials besides plywood are also within the scope of the present disclosure, including other wood, plastic, metal, and honeycomb stiffening members.

As mentioned above, the outer container 22 includes a lower portion 32 and an upper portion 34, which are couplable to one another at an interface 36. The interface 36 is suitably designed to resist spillage or leakage of any contents from the assembly 20 and also, in the case of a fire, to prevent any flames from entering the outer container 22 at the interface 36. Referring to FIGS. 3 and 6-8, the interface 36 between the lower portion 32 and the upper portion 34 is a stepped joint 36. The stepped joint 36 makes it difficult for the upper portion 34 to be removed or knocked from the lower portion 32, for example, when the outer container 22 is standing in its upright position, but not secured by its closure system 38. In addition, the stepped joint 36 reduces the risk of flame impingement into the outer container 22 at the interface 36 by blocking the direct path for a flame into the outer container 22.

Figure 6:
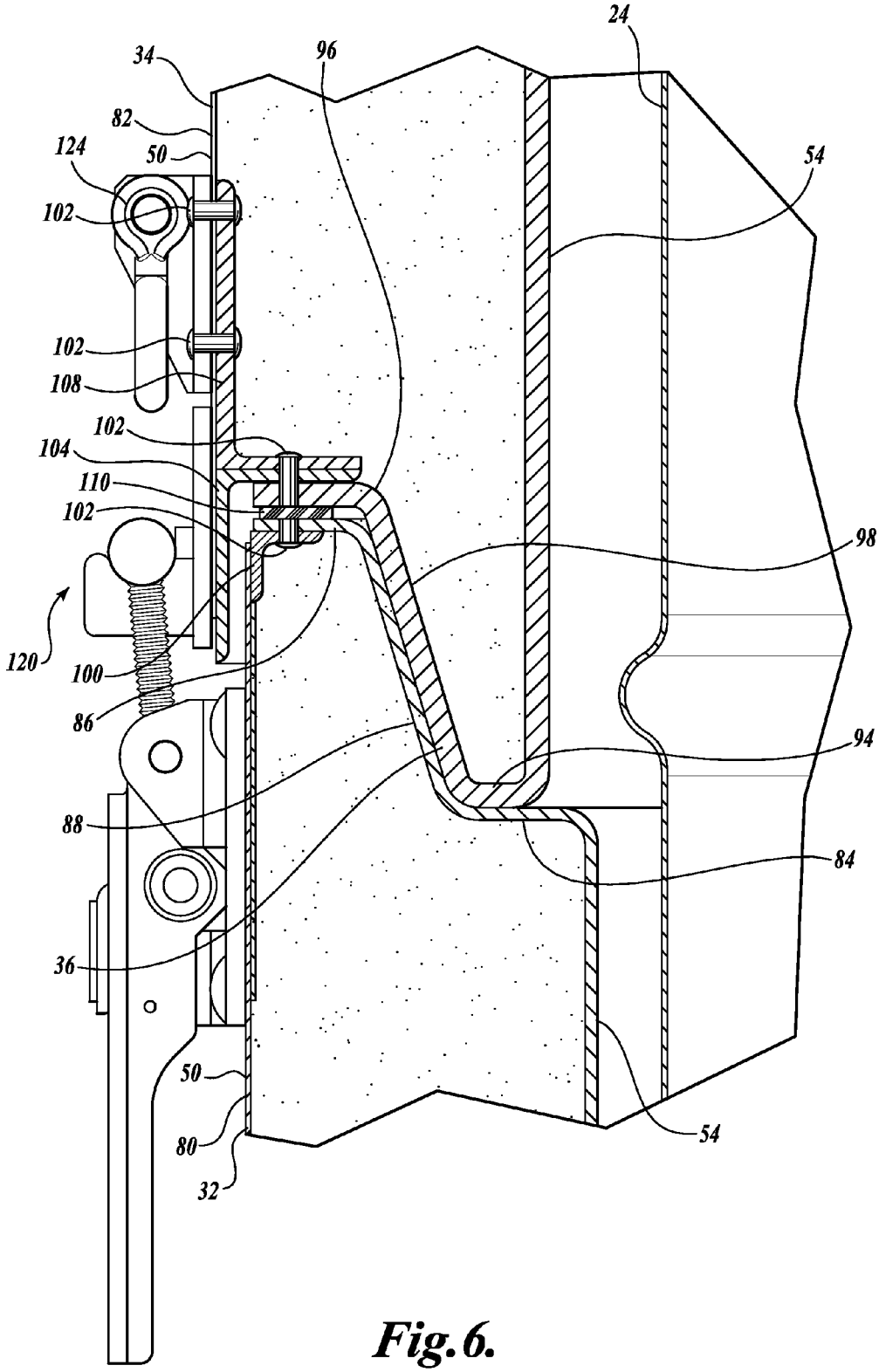
FIG. 6 is a partial, close-up, cross-sectional view of an interface between lower and upper portions of the outer container and a latch of the transportation assembly of FIG. 1.
Figure 7:
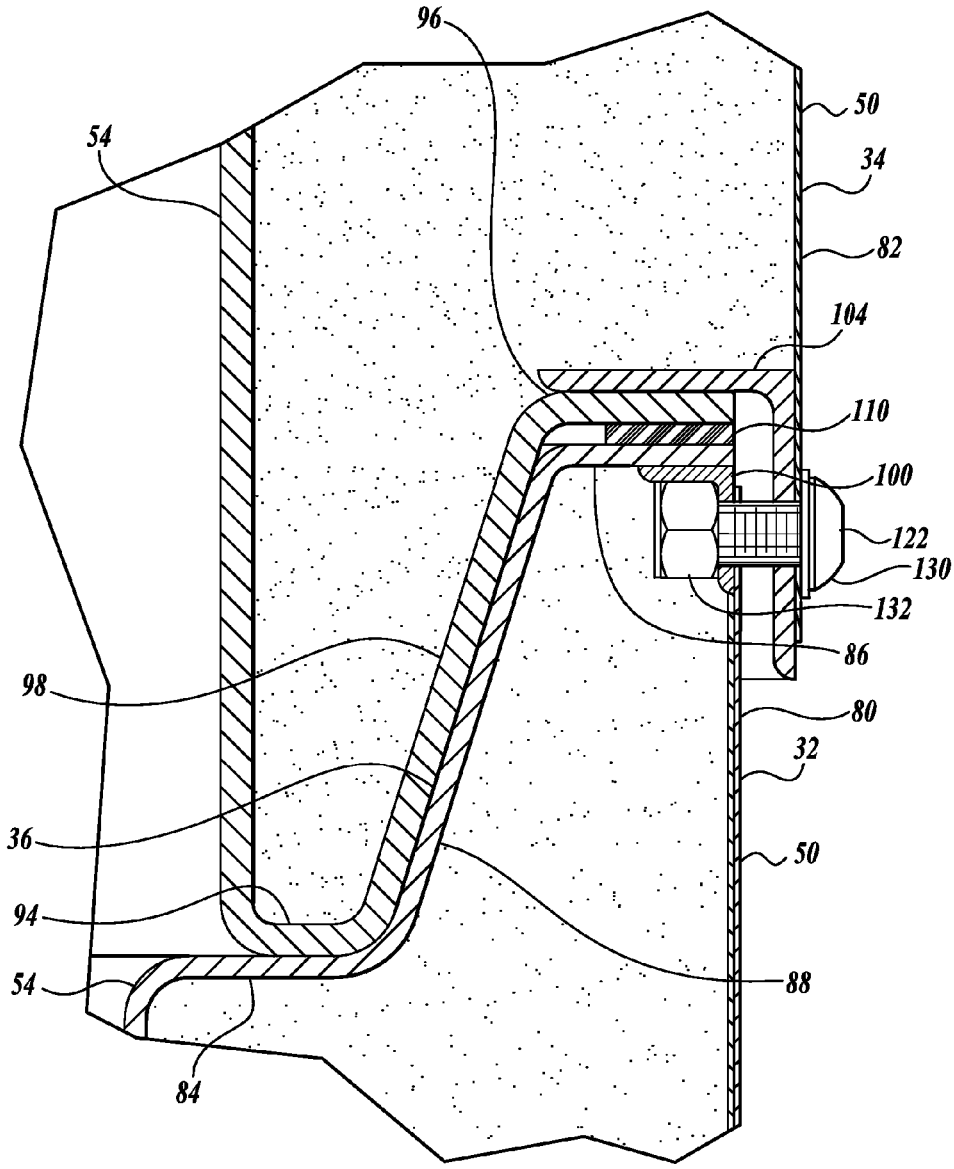
FIG. 7 is a partial, close-up, cross-sectional view of an interface between lower and upper portions of the outer container and a fastener of the transportation assembly of FIG. 1 taken through plane 7-7 shown in FIG. 2.
Figure 8:
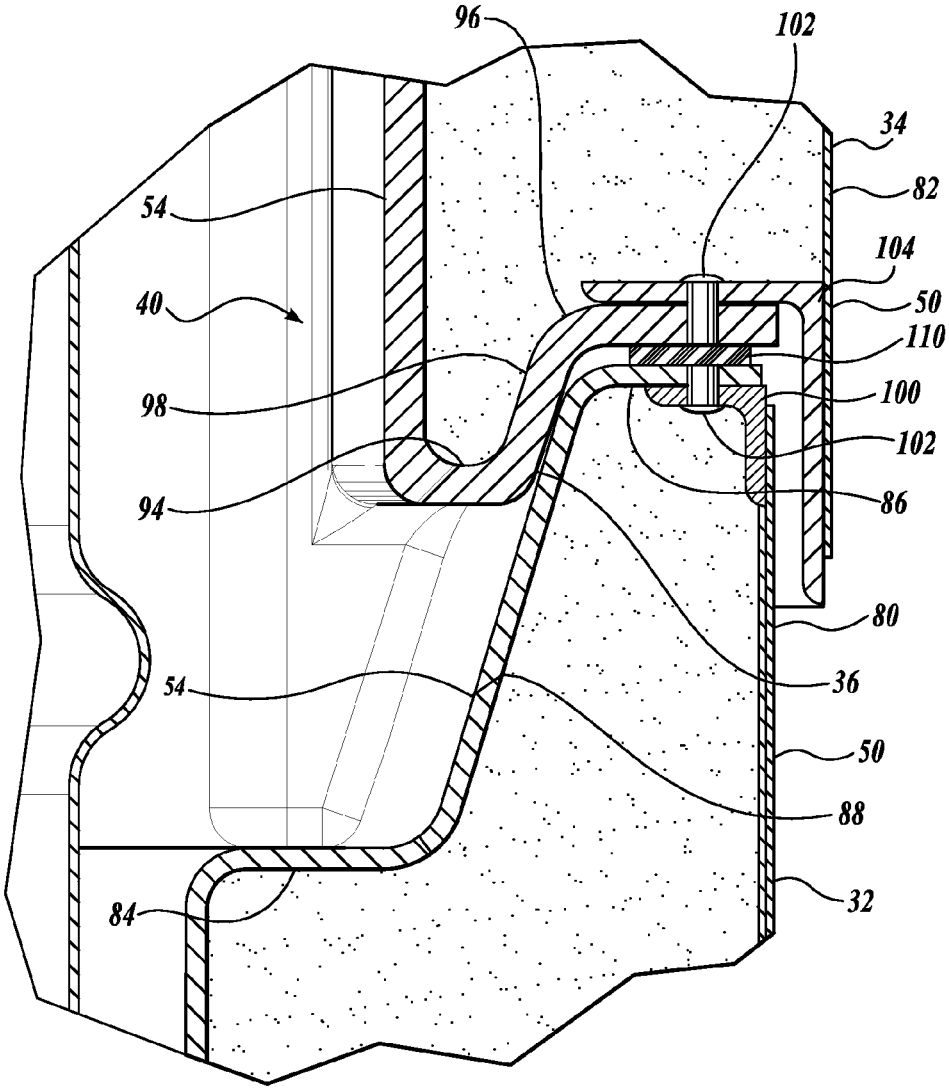
FIG. 8 is a partial, close-up, cross-sectional view of an interface between lower and upper portions of the outer container and a recess in the upper portion of the transportation assembly of FIG. 1.

Briefly described, FIGS. 6-8 are partial, close-up, cross-sectional views of the interface 36 between the lower and upper portions 32 and 34 of the outer container 22, taken through three different longitudinal planes of the container. In that regard, FIG. 6 also shows a latch 120 in cross section, FIG. 7 shows a fastener 122 in cross section, and FIG. 8 shows a recess 40 in the upper portion 34 in cross section, all of which are described in greater detail below.

As best seen in FIGS. 6-8, in the stepped joint 36, the lower portion 32 includes a first rim portion 80 that is couplable with a corresponding second rim portion 82 on the upper portion 34. The first rim portion 80 includes a lower annular lip 84 and an upper annular lip 86, both of which are substantially horizontally oriented when the outer container 22 is in its upright, standing position, as shown in FIGS. 1 and 3. The first rim portion 80 further includes a beveled portion 88, which extends outwardly from the lower annular lip 84 to the upper annular lip 86.

The second rim portion 82 is designed to correspondingly interface with the first rim portion 80. In that regard, the second rim portion 82 also includes a lower annular lip 94 and an upper annular lip 96, both of which are substantially horizontally oriented when the outer container 22 is in its upright, standing position, as shown in FIGS. 1 and 3. The second rim portion 82 further includes a beveled portion 98, which extends inwardly from the upper annular lip 96 to the lower annular lip 94.

When the lower and upper portions 32 and 34 of the outer container 22 are joined with one another at the interface 36, the beveled portions 88 and 98 of the respective first and second rim portions 80 and 82 align with one another, such that the upper annular lip 96 of the second rim portion 82 and the upper annular lip 86 of the first rim portion 80 compress a sealing element, such as a gasket 110, as seen in the illustrated embodiment of FIGS. 6-8. When aligned, the lower annular lip 94 of the second rim portion 82 is in contact with the lower annular lip 84 of the first rim portion 80. Therefore, when the outer container 22 is in its upright, standing position, as shown in FIGS. 1 and 3, the upper portion 34 of the outer container 22 is supported by the lower portion 32 along the interface 36.

Referring to FIGS. 6-8, the respective inner shells 54 of the lower and upper portions 32 and 34 of the outer container 22 may extend along the inner surfaces of the lower and upper portions 32 and 34 to the first and second rim portions 80 and 82 to provide additional impact resistance, toughness, and strength reinforcement at the interface 36 between the lower and upper portions 32 and 34. In addition, the first and second rim portions 80 and 82 may further include reinforcing structural angles 100 and 104 at the interface 36 to provide improved structural integrity at the joint.

The structural angles 100 and 104 add structural strength to the lower and upper portions 32 and 34 of the outer container 22 by distributing loads placed on the outer container 22. It should be appreciated that the structural angles 100 and 104 may include a plurality of discreet L-shaped structural angles positioned, for example, at the locations of the coupling devices, such as latches and fasteners 120 and 122 described below, or may include continuous angles, for example, extending along the entirety of the perimeter of the lower and upper portions 32 and 34 of the outer container 22.

As best seen in FIGS. 6-8, the first rim portion 80 includes an annular structural angle 100 extending downwardly around the perimeter of the outer corner of the first rim portion 80. In that regard, the structural angle 100 has a first, substantially horizontal portion that is attached to the inner surface of the inner shell 54 of the upper annular lip 86 of the first rim portion 80 and a second, substantially vertical portion that is attached to an inner surface of the outer shell 50 of the first rim portion 80. In the illustrated embodiment, the first structural angle 100 is secured to the first rim portion 80 at the upper annular lip 86 by rivet 102. However, it should be appreciated that the structural angle 100 may be secured to the outer container 22 by any suitable attachment means, including but not limited to, one or more pins, screws, bolts, welding, adhesive, or any other suitable fastening means.

Still referring to FIGS. 6-8, the second rim portion 82 also includes an annular structural angle 104 extending downwardly around the perimeter of the outer corner of the second rim portion 82. In that regard, the structural angle 104 has a first, substantially horizontal portion that is attached to the inner surface of the inner shell 54 of the upper annular lip 96 of the second rim portion 82 and a second, substantially vertical portion that is attached to an inner surface of the outer shell 50 of the second rim portion 82. In the illustrated embodiment, structural angle 104 extends from the second rim portion 82 as an downwardly depending flange to provide a cover to both the interface 36 and a portion of the first rim portion 80. Like the first structural angle 100, the second structural angle 104 may be secured to the second rim portion 82 by any suitable attachment means, including but not limited to, a rivet 102, as seen in the illustrated embodiment, one or more pins, screws, bolts, welding, adhesive, or any other suitable fastening means.

Now referring to FIG. 6, the second rim portion 82 includes a third type of structural angle, a discreet L-shaped structural angle 108 to provide additional structure to the outer container 22 at the attachment point of one of the plurality of latches 120 and lift assemblies 124, as described in greater detail below. It should be appreciated that individual structural angles 108 can be used at each of the attachment points for each of the plurality of latches 120. As seen in FIG. 6, structural angle 108 extends upwardly around the perimeter of the outer corner of the second rim portion 82. In that regard, the structural angle 108 has a first, substantially horizontal portion that is attached to the inner surface of the inner shell 54 of the upper annular lip 96 of the second rim portion 82, interfacing with the substantially horizontal portion of structural angle 104. The structural angle 108 further includes a second, substantially vertical portion that is attached to an inner surface of the outer shell 50 of the second rim portion 82. Like the other structural angles 100 and 104, the third structural angle 108 may also be secured to the second rim portion 82 by any suitable attachment means, including but not limited to, rivets 102, as seen in the illustrated embodiment, one or more pins, screws, bolts, welding, adhesive, or any other suitable fastening means.

Returning to FIGS. 6-8, at the interface 36 between the lower and upper portions 32 and 34 of the outer container 22, a gasket 110 is positioned to seal the interface 36, for example, to resist spillage or leakage of material being carried by the assembly 20 and to further reduce the risk of flame impingement into the outer container 22 at the interface 36. In the illustrated embodiment, the gasket 110 is positioned between the upper annular lip 86 of the first rim portion 80 and the upper annular lip 96 of the second rim portion 82. However, it should be appreciated that the gasket may be positioned in other suitable locations, for example, between the lower annular lips 84 and 94 or between the beveled portions 88 and 98 of the respective first and second rim portions 80 and 82. While the gasket 110 is suitably configured to resist spillage or leakage of material being carried by the assembly 20, the gasket 110 can be configured to allow gases to pass from the inner cavity 23 of the inner container 22 to the exterior environment and prevent over-pressurization of the inner cavity 23. For additional venting purposes, the outer container 22 may include a plurality of vents 116 on the outer surface of the outer container 22 to release any gases generated by the intermediate liner 52, for example, generated by a polyurethane foam.

The gasket 110 is preferably a high temperature ceramic gasket, as a non-limiting example, heat resistant up to 2100° F. In one embodiment, the ceramic gasket is made from alumina silicate fibers formed into a yarn, which are then braided and formed into ¼ inch square braided ceramic rope encased within a 1-inch diameter braided ceramic sleeve. In one embodiment, the ceramic gasket has a silicone coating, such as a room temperature vulcanizing (RTV) silicone coating, to prevent fraying of the ceramic gasket. The silicone coating is designed so that no fibers from the ceramic gasket can enter the outer container 22 or the inner container 24 and contaminate the uranium oxide powder. As described in greater detail below, a similar gasket can also be used to seal the closure system 42 of the inner container 24.

Returning to FIG. 1, the lower and upper portions 32 and 34 of the outer container 22, once coupled to one another, are securable in a closed configuration by a closure system 38 located along the outer perimeter of the outer container 22 at the interface 36 between the lower and upper portions 32 and 34. In that regard, the closure system 38 includes a plurality of latches 120 and fasteners 122, as seen in the close-up views of FIGS. 6 and 7. In the illustrated embodiment, the closure system 38 includes four heavy duty latches 120 and eight fasteners 122; however, it should be appreciated that more or less latches 120 and fasteners 122 are within the scope of the present disclosure.

As best seen in FIGS. 1 and 6, the latches 120 secure the lower and upper portions 32 and 34 of the outer container 22 to one another. In one embodiment of the present disclosure, the latches 120 are high capacity, over-center locking latch devices, such as latches have a breaking strength of 4400 lbs, for example, latch 41-1292WB manufactured by Protex Fasteners Ltd. As a non-limiting example, the latches 120 and their respective catch plates may be made of steel, such as stainless steel, and may have a zinc finish. It should be appreciated that the latches 120 may include a safety catch preventing the accidental release of the latch, for example, by being locked by a sealing pin or tamper-indicating wire secured in the latch handles. It should further be appreciated that the latches may also be adjustable to provide alignment adjustment when the lower and upper portions 32 and 34 of the outer container 22 are coupled to one another. As described above, structural angles 108 or other structural components can provide structural attachment points for at least a portion of the latch 120. The latches 120 and/or any structural angles 108 proving structural support for latch attachment may be secured to the outer container 22 by any suitable attachment means, including but not limited to, one or more rivets, pins, screws, bolts, welding, adhesive, or any other suitable fastening means.

In addition to the plurality of latches 120, the closure system 38 further includes a plurality of fasteners 122, including, but not limited to, screws and nuts 130 and 132, located around the exterior perimeter of the interface 36 between the lower and upper portions 32 and 34 of the outer container 22, as best seen in FIGS. 1 and 7. In the illustrated embodiment, the screws 130 enter through the outer shell 50, reinforced by structural angle 104, of the downwardly depending flange of the upper portion 34. The screws 130 engage with nuts 132 embedded in the intermediate liner 52 of the lower portion 32 of the outer container 22, also reinforced by a structural angle 100. In another embodiment, in place of nut 132, a helicoil insert and tapped bar may be used to received screws 130. These fasteners 122 provide added securement points for maintaining the integrity of the connection between the lower and upper portions 32 and 34 of the outer container 22, thus decreasing the chance that the outer container 22 will open upon impact, for example, if the assembly 20 is crushed or dropped. It should be appreciated that the screws 130 may be designed to be cold temperature fracture resistant to further prevent failure upon impact, for example, if the assembly 20 is crushed or dropped in cold temperatures.

It should be appreciated that the plurality of latches 120 and fasteners 122 are suitably alternatingly oriented such that adjacent assemblies 22, when positioned along side one another for storage, can be closely packed next to one another without latches 120 of adjacent assemblies 20 aligning to interfere with one another resulting in a puncture or preventing close packing next to one another.

Returning to FIG. 1, the assembly 20 also includes a plurality of lift assemblies 124 suitably located along the outer surface of the outer container 22. The lift assemblies 124 suitably include a structural tee with a hole to attach a shackle. As is well known in the art, such lift assemblies 124 can be used to lift and transport the assembly 20 when the assembly is in its upright orientation, as shown in FIGS. 1 and 3. The lift assemblies 124 and/or any structural angles 108 providing structural support for lift assembly attachment may be secured to the outer container 22 by any suitable attachment means, including but not limited to, one or more rivets, pins, screws, bolts, welding, adhesive, or any other suitable fastening means.

Figure 9:
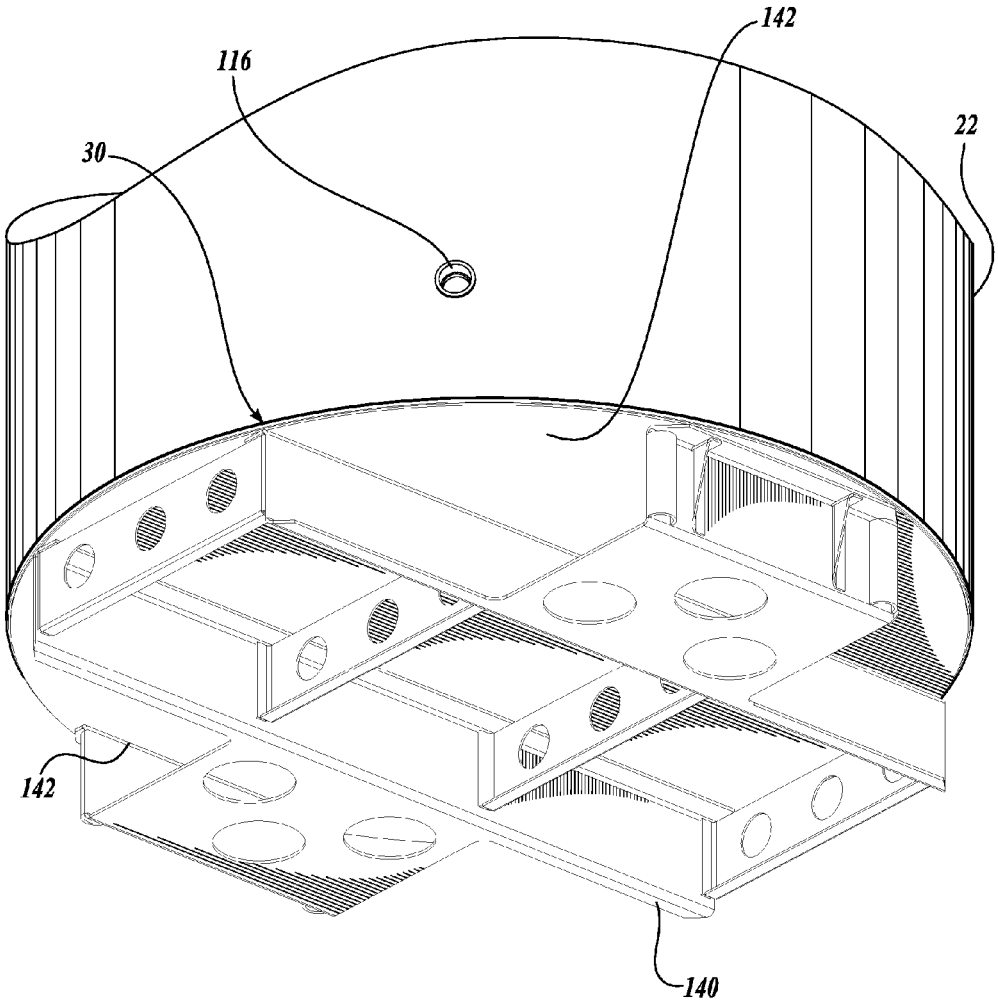
FIG. 9 is a partial perspective front view showing a forklift assembly of the transportation assembly of FIG. 1.

Referring now to FIGS. 1 and 9, a forklift assembly 140 is suitably provided on the bottom end or base 30 of the outer container 22. In the illustrated embodiment, the forklift assembly 140 includes a plurality of pockets 142 designed and configured to receive forklift forks. As best seen in FIG. 9, the pockets 142 can be oriented such that the latches 120 and lift assemblies 124 on the outer container 22 are at a 45 degree angle relative to the pockets 142 to facilitate close stacking of adjacent assemblies 20 and prevent possible punctures to adjacent assemblies. The forklift assembly 140 also provides additional structural support to the outer container 22 for damage resistance when the assembly 20 is either crushed or dropped. In that regard, the forklift assembly 140 is designed to be crush absorbing. For example, in one embodiment, the forklift pockets 142 are configured from folded 12 gauge galvanized carbon steel or stainless steel sheet, with bracing from 14 gauge galvanized carbon steel or stainless steel sheet. The forklift assembly 140 is therefore configured to collapse when the assembly 20 is crushed or dropped to absorb the impact of the crush or drop forces.

Returning to FIG. 3, the inner container 24 of the assembly will now be described in greater detail. The inner container 24 is designed and configured to support and contain radioactive material. In that regard, the inner container 24 includes a body portion 150, a bottom portion 152, and a lid 154. In one embodiment, the inner container 24 is a 55-gallon rolled steel cylindrical drum having a single welded seam, a closed bottom end, and an open top end, closeable by a lid. However, it should be appreciated that the inner container may be any suitable design or configuration so as to be cooperatively received within the inner cavity 23 of the outer container 22. The inner container 24 may be made from any suitable materials to provide strength and resist leakage or spillage of the contained material into the inner cavity 23 of the outer container 22. While it should be appreciated that other materials are within the scope of the present disclosure, in one embodiment, the inner container 24 is made from 16 gauge carbon steel, stainless steel, or an equivalent material. In yet another embodiment, the inner container 24 has 7A Type A and UN specification ratings.

The lid 154 of the inner container 24 is designed to be received at an upper rim 156 of the body portion 150 of the inner container 24. The lid 154 is designed to be removable to receive or remove the contained material. When closed, the lid 154 includes a reinforced closure system 42 to ensure containment of the radioactive material, particularly when the assembly 20 is subjected to normal conditions of transport and hypothetical accident conditions, for example, immersion in water. In the illustrated embodiment, the closure system 42 includes a reinforced closure ring 158 having a flange 160 that is attachable to the upper rim 156 and body portion 150 of the inner container 24, for example, a clamshell closure as described in U.S. Patent Application Publication No. U.S. 2005/0269331 A1, published on Dec. 8, 2005, the disclosure of which is hereby incorporated by reference. The clamshell closure is generally a modified two-piece C-ring including a two-bolt closure system.

The clamshell closure system 42 may further include a gasket (not shown) between the lid 154 and the upper rim 156 of the inner container 22 to seal the closure, for example, to resist spillage or leakage of material being carried by the inner container 24 and to further reduce the risk of flame impingement into the inner container 24 at the lid 154. It should be appreciated that the gasket may be a ceramic gasket, for example, similar to ceramic gasket 110 described above, and may have an optional silicone coating.

As mentioned above, and as best seen in FIG. 2 showing the top view of the assembly 20, the upper portion 34 of the outer container 22 includes recesses or keyways 40 in the inner cavity 23 designed to accommodate the bolts of the two-bolt closure system 42 on the inner container 24, for example, the two-bolt closure system used to secure the clamshell closure described above.

While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. A transportation assembly for transporting radioactive material, comprising:

(a) an outer container having first and second ends, wherein the outer container defines an inner cavity, the outer container having an inner shell, wherein at least a portion of the inner shell comprises a plurality of layers including at least one layer of chopped fiberglass mat, at least one layer of aramid fabric, and at least one layer of a double bias glass fabric, the inner shell further including at least one stiffening member disposed at either of the first and second ends of the outer container, wherein the stiffening member is substantially transverse to a longitudinal axis extending from the first end to the second end; and (b) an inner container disposed within the inner cavity of the outer container.

2. The assembly of claim 1, wherein the assembly is designed and configured to transport fissile material.

3. The assembly of claim 1, wherein the outer container further includes an outer shell.

4. The assembly of claim 3, wherein the outer container further includes an intermediate liner disposed between the inner shell and the outer shell.

5. The assembly of claim 3, wherein the outer shell is galvanized carbon steel or stainless steel.

6. The assembly of claim 4, wherein the intermediate liner is polyurethane foam.

7. The assembly of claim 1, wherein at least a portion of the inner shell includes at least seven layers, including double bias glass fabric, chopped fiberglass, aramid fabric, double bias glass fabric, chopped fiberglass, aramid fabric, and double bias glass fabric.

8. The assembly of claim 1, wherein at least a portion of the inner shell includes at least ten layers, including double bias glass fabric, chopped fiberglass, aramid fabric, four layers of double bias glass fabric, chopped fiberglass, aramid fabric, and double bias glass fabric.

9. The assembly of claim 1, wherein the outer container includes first and second ends and wherein at least a portion of the inner shell at either of the first and second ends further includes a stiffening member.

10. The assembly of claim 1, wherein the inner container has a body and a lid, and wherein the inner container includes a clamshell closure system to secure the lid to the body.

11. The assembly of claim 10, wherein the outer container includes at least one recessed area in the inner cavity to receive the clamshell closure system.

12. The assembly of claim 1, wherein the inner container has a body and a lid, and wherein the inner container includes a ceramic gasket disposed between the body and the lid.

13. The assembly of claim 1, wherein the outer container includes first and second portions couplable to one another at an interface and a ceramic gasket disposed at the interface.

14. The assembly of claim 13, wherein the ceramic gasket is a silicone-coated ceramic gasket.

15. The assembly of claim 13, wherein the first and second portions, when coupled to one another at the interface, are securable to one another by a plurality of latches and a plurality of fasteners.

16. The assembly of claim 1, wherein the outer container includes at least one forklift pocket for transportation of the assembly by a forklift.

17. An outer container to provide protection for an inner container for transporting radioactive material, the outer container comprising first and second portions defining an inner cavity, the first and second portions both having an inner shell, wherein at least a portion of the inner shell comprises a plurality of layers including at least one layer of chopped fiberglass mat, at least one layer of aramid fabric, and at least one layer of a double bias glass fabric, wherein the inner shell further includes at least one stiffening member disposed in either of the first and second portions of the outer container, the stiffening member being oriented in a plane substantially transverse to a longitudinal axis extending through the outer container.

18. The outer container of claim 17, wherein at least a portion of the inner shell includes at least seven layers, including double bias glass fabric, chopped fiberglass, aramid fabric, double bias glass fabric, chopped fiberglass, aramid fabric, and double bias glass fabric.

19. The outer container of claim 17, wherein at least a portion of the inner shell includes at least ten layers, including double bias glass fabric, chopped fiberglass, aramid fabric, four layers of double bias glass fabric, chopped fiberglass, aramid fabric, and double bias glass fabric.

20. The outer container of claim 17, further comprising first and second ends, wherein at least a portion of the inner shell at either of the first and second ends further includes a stiffening member.

21. An outer container to provide protection for an inner container for transporting radioactive material, the outer container comprising:

(a) first and second portions coupled to one another at an interface, wherein the first and second portions define an inner cavity, the first and second portions each having an inner shell, wherein at least a portion of the inner shell comprises a plurality of layers including at least one layer of chopped fiberglass mat, at least one layer of aramid fabric, and at least one layer of a double bias glass fabric, wherein the inner shell further includes at least one stiffening member disposed in either of the first and second portions of the outer container, the stiffening member being oriented substantially transverse to a longitudinal axis extending through the outer container; and (b) an outer container closure system for securing the first and second portions to one another, wherein the outer container closure system includes a plurality of latches and a plurality of fasteners.

22. The outer container of claim 21, wherein the outer container includes at least one forklift pocket for transportation of the assembly by a forklift.

23. A method of transporting radioactive material, comprising:

(a) placing an inner container into an outer container, wherein the inner container contains the radioactive material, and the outer container includes first and second portions defining an inner cavity, the first and second portions both having an inner shell, wherein at least a portion of the inner shell comprises a plurality of layers including at least one layer of chopped fiberglass mat and, at least one layer of aramid fabric, and at least one layer of a double bias glass fabric, wherein the inner shell further includes at least one stiffening member disposed in either of the first and second portions of the outer container, the stiffening member being oriented in a plane substantially transverse to a longitudinal axis extending through the outer container; and (b) securing the first and second portions of the outer container using an outer container closure system, wherein the outer container closure system includes a plurality of latches and a plurality of fasteners.

* * * * *

UNITED STATES PATENT AND TRADEMARK OFFICE

CERTIFICATE OF CORRECTION

PATENT NO. : 8,003,966 B2
APPLICATION NO. : 11/844968
DATED : August 23, 2011
INVENTOR(S) : C. J. Temus et al.

It is certified that error appears in the above-identified patent and that said Letters Patent is hereby corrected as shown below:

| COLUMN | LINE | ERROR |
|---|---|---|
| 14 (Claim 23, | 3-4 lines 9-10) | "fiberglass mat and, at least one" should read --fiberglass mat, at least one-- |

Signed and Sealed this
Twenty-eighth Day of August, 2012

David J. Kappos

David J. Kappos
*Director of the United States Patent and Trademark Office*